United States Patent [19]

Drake et al.

[11] Patent Number: 4,978,557

[45] Date of Patent: Dec. 18, 1990

[54] METHOD OF ARC SPRAYING

[75] Inventors: Curtis L. Drake, Elizabeth Township; Allegheny County; Francis L. Przywarty, Jefferson Boro; Robert L. Ammon, Pittsburgh, all of Pa.

[73] Assignee: Westinghouse Electric Corp., Pittsburgh, Pa.

[21] Appl. No.: 478,727

[22] Filed: Feb. 12, 1990

Related U.S. Application Data

[63] Continuation of Ser. No. 268,100, Nov. 7, 1988, abandoned.

[51] Int. Cl.[5] ..... B05D 3/06; B05D 1/08

[52] U.S. Cl. ..... 427/37; 427/133; 427/177; 427/404; 427/423

[58] Field of Search ..... 427/34, 423, 37, 178, 427/177, 422, 404; 219/76.14

[56] References Cited

U.S. PATENT DOCUMENTS 4,518,625 5/1985 Westfall ..... 427/37

*Primary Examiner*—Bernard Pianalto

*Attorney, Agent, or Firm*—Fred J. Baehr, Jr.

[57] ABSTRACT

A method of improving the quality of metal matrix fiber reinforced monotape and thin foil overlays made by the arc spray process by tailoring the surface finish of mandrels used in the process to the overlay being formed and making the mandrels of materials with high thermal conductivity so that the spray applied overlays hold and adhere to the mandrel during the spraying process and are easy to remove from the mandrel without damaging the overlay after the spray has solidified.

4 Claims, 1 Drawing Sheet

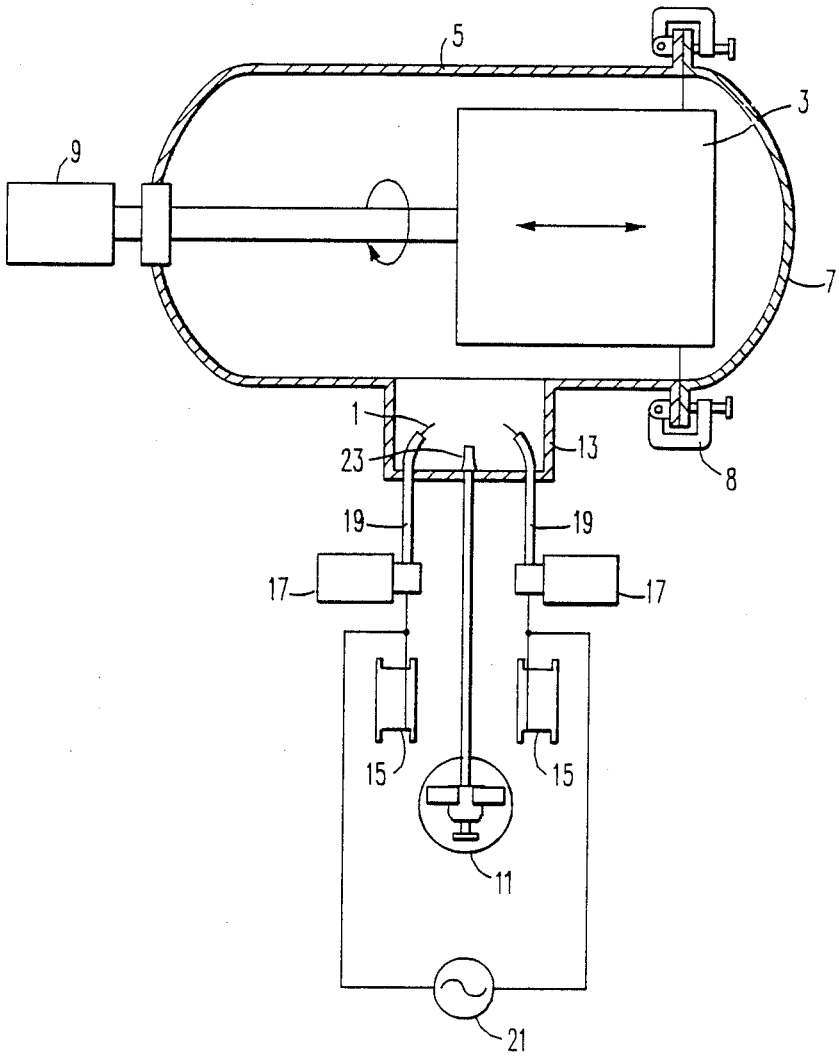
5
3
9
7
1
23
13
8
19
19
17
17
15
15
11
21

METHOD OF ARC SPRAYING

This application is a continuation of application Ser. No. 268,100, filed Nov. 7, 1988.

BACKGROUND OF THE INVENTION

The invention relates to an arc spray process for making foil and metal matrix composites and more particularly to a method of improving the mandrels utilized therein.

U.S. Pat. No. 4,518,625 describes arc metal spraying used to spray liquid metal onto an array of high strength fibers that have been previously wound onto a large drum or mandrel contained inside a controlled atmosphere chamber. This chamber is first evacuated to remove gaseous contaminants and then back filled with a neutral gas up to atmospheric pressure. This process is used to produce a large size metal matrix composite monotape.

SUMMARY OF THE INVENTION

Among the objects of the invention may be noted the provision of a mandrel which will provide a surface to which the molten spray will adhere and a surface which will release the solidified monotape or foil from the mandrel after the spray has solidified.

In general, a method of improving arc spray deposition of a metal overlay on a mandrel, when performed in accordance with this invention, comprises providing a mandrel of a material which has high thermal conductivity to rapidly remove heat form the overlay and providing a mandrel with a surface finish tailored to the the overlay being formed, in order to hold and capture the overlay when it is being formed and to allow the formed overlay to be stripped from the mandrel without damaging the overlay.

BRIEF DESCRIPTION OF THE DRAWINGS

The invention as set forth in the claims will become more apparent by reading the following detailed description in conjunction with the accompanying drawings, and in which:

The Sole FIGURE is a schematic drawing of the apparatus utilized in the arc spray process.

DESCRIPTION OF THE PREFERRED EMBODIMENT

Referring now to the drawings in detail and in particular to the sole FIGURE there is shown a schematic of apparatus utilized in an arc spray process, which deposits spray from wires 1 melted by an arc on a mandrel 3. The mandrel 3 is disposed in a vessel 5 having a head 7 sealably affixed to the vessel by hinged C-clamps 8. The mandrel 3 is removably attached to a drive mechanism 9, which rotates the mandrel 3 and moves it axially within the vessel 5 causing the stream of molten metal from the arc spray to trace a spiral path over the outside of the mandrel 3. A vacuum pump (not shown) is used to evacuate the vessel 3 prior to filling it with inert gas supplied from a tank 11. An arc spray chamber 13 is disposed on one side of the vessel 5 and opens thereto. A pair of wire feeding devices comprising a pair of spools 15 containing the desired wire, a pair of variable speed independently controlled wire drive mechanisms 17 and a pair of wire tubes 19, which cooperate to feed two wires 1 into the arc spray chamber 13 so that the distal ends of the wires 1 move toward each other at a controlled rate. An alternating current or AC power supply 21 is connected to the wires 1 to apply a sufficiently high AC voltage to the wires to produce an arc between the distal ends of the wires 1 causing the distal ends to melt. Inert gas from the tank 11 is feed through a nozzle 23 to produce a high velocity stream which blows a stream of molten metal from the distal ends of the wire 1 toward the mandrel 3. The mandrel 3 is preferably made of a material having high thermal conductivity such as aluminum and is generally cylindrical with an outer peripheral surface having a finish, the roughness of which varies depending on the product being made, monotapes or thin foils. When overlays in the form of metal matrix monotapes are being produced a surface roughness with a root mean square, rms, value of 16 or less is preferred and when overlays in the form of thin foils are being produced a rougher surface formed by rough emery paper or rough grit sand or glass bead blasting is preferred such a surface may have a rms value of approximately 50 or more. In the case of monotape production the array of fiber reinforcement wrapped on the mandrel 3 operates to capture and hold the overlay or matrix material deposited by the arc spray even though the surface is very smooth, 16 rms or less. This fine finish facilitates removal of the monotape from the mandrel 3 without damaging the monotape. In the production of foil in addition the requirement of a rough surface, 50 rms or greater, a few wraps of filament on each end of the mandrel 3 is utilized to define the lateral edges of the foil, to prevent tearing of the fragile edges of the foil during removal of the foil from the mandrel 3 and provide a surface to which the molten stream from the arc spray will adhere.

The method of operating this metal spray apparatus to make a metal overlay is as follows:

The spools 15 are wrapped with wire 1, the wire 1 may be any metal or metal alloy. The same or different wires can be wrapped on each spool 15 depending on the desired properties of the matrix to be formed. Mandrels 3 made from a material with a high thermal conductivity, such as aluminum and having a outer peripheral surface finish tailored to the overlay, smoother surfaces for overlays such as metal matrix composite monotapes and rougher surfaces for thin foils, are selected. The selected mandrel 3 is sprayed with a commercially available mold release agent such as Fluorglide® made by Norton Inc., a 111 trichloroethane and fluorotelomene mixture. If a metal matrix composite monotape is being made the selected mandrel 3 is overlaid with an array of high strength fibers such as tungsten alloy, silicon carbide or any other fiber. If foil is being made no fiber overlay is used, however it is desirable to wrap a wire or fiber around the mandrel adjacent each of the ends or slightly further apart than the desired width of the foil to form wire rings so that to remove the overlay a longitudinal cut is made through the overlay and wire rings allowing the overlay to be peeled from the mandrel. As the overlaid foil is peeled from the mandrel 3 it will tear at the wire rings eliminating the frayed side margins normally produced when the wire rings are omitted. Then the selected mandrel 3 is connected to the drive mechanism g, which is adapted to rotate the mandrel 3 and translate it axially causing the stream of molten metal from the arc spray to follow a spiraling path over the outer surface of the mandrel 3. The vessel 5 is closed, sealed, purged, evacuated and filled with an inert gas such as argon. The wire 1 from the spools 15 is feed through the wire drives 17 and wire tubes 19 into the spray chamber 13. Inert gas is supplied through the nozzle 23. The mandrel drive mechanism g rotates and translates the mandrel 3 axially causing a spiraling motion with respect to the stream of molten metal from the arc spray. Typically the mandrel 3 is rotated about 60 rpm and moves axially at about 60 inches a minute. While this is the preferred operation it is understood that the mandrel could be rotated slowly and rapidly reciprocated axially so as to operate sort of like an electric typewriter or printer which prints in both directions. As the distal ends of the wires 1 approach each other an arc is formed creating sufficient heat to melt the distal ends of the wires 1. The inert gas flowing through the nozzle 23 at high velocity disbursing the molten wire 1 which flows in a molten stream directed toward the mandrel 3 upon which it collects and solidifies overlaying the array of fibers forming a metal composite monotape or overlaying the mandrel 3 to form a foil. To remove the overlay, the overlay and fibers and/or wire rings are cut longitudinally or parallel to the axis of the mandrel 3 to produce an edge which is picked from the mandrel allowing the overlay to be easily peeled from the mandrel due to the proper combination of surface roughness, thickness and rapid cooling of the overlay. When forming a foil the spray is deposited beyond the end wire or fiber rings, however the overlay is normally thinner and irregular thickness outboard of the wire rings and when removing the foil it will tear at the wire rings to produce an even margin on the side margins of the foil. The overlay out board of the wires remains on the mandrel 3 and is removed after the foil has been removed.

Utilizing mandrels 3 with high thermal conductivity and with varying surface finishes advantageously provide mandrels 3, which hold and capture the molten spray and yet allow the solidified overlay to be easily removed from the mandrel 3. Wrapping a wire or fiber around the mandrel 3 adjacent each end to form a ring advantageously produces an even margin on each end of the foil when it is pealed from the mandrel 3.

While the preferred embodiments described herein sets forth the best mode to practice this invention presently contemplated by the inventor, numerous modifications and adaptations of this invention will be apparent to others skilled in the art. Therefore, the embodiments are to be considered as illustrative and exemplary and it is understood that numerous modifications and adaptations of the invention as described in the claims will be apparent to those skilled in the art. Thus, the claims are intended to cover such modifications and adaptations as they are considered to be within the spirit and scope of the invention.

What is claimed is:

1. A method of improving arc spray deposition of a metal overlay on a mandrel comprising the steps of:

providing a mandrel of a material which has high thermal conductivity to rapidly remove heat from the overlay; and providing a mandrel with a surface finish having a roughness which is tailored to the overlay being formed, a surface roughness of about 16 rms, root mean square or less when a fiber reinforced metal matrix composite monotape is being formed and a surface roughness in the range of about 50 rms, root mean square, or more when a thin foil is being formed, in order to capture and hold the overlay when it is being formed and to allow the formed overlay to be stripped from the mandrel without damaging the overlay.

2. The method of claim 1 further comprising the steps of coating the mandrel with a mold release agent; then wrapping the mandrel with fibers and spraying the metal overlay on the mandrel.

3. The method of claim 2, wherein the step of wrapping the mandrel with fibers comprises wrapping the mandrel with an array of high strength fibers and the step of spraying the metal overlay comprises spraying the quantity of metal necessary to form a fiber reinforced metal matrix composite monotape on the mandrel.

4. The method of claim 2, wherein the step of wrapping the mandrel with fibers comprises wrapping the mandrel adjacent each end thereof with a fiber forming a ring adjacent each end of the mandrel and the step of spraying the metal overlay comprises spraying the quantity of metal necessary to form a thin foil on the mandrel.

* * * * *